US010394155B2

(12) United States Patent
Miyamoto

(10) Patent No.: US 10,394,155 B2
(45) Date of Patent: Aug. 27, 2019

(54) IMAGE FORMING APPARATUS

(71) Applicant: CANON KABUSHIKI KAISHA, Tokyo (JP)

(72) Inventor: Akinori Miyamoto, Bando (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/981,230

(22) Filed: May 16, 2018

(65) Prior Publication Data

US 2018/0335713 A1 Nov. 22, 2018

(30) Foreign Application Priority Data

May 19, 2017 (JP) ..... 2017-100178

(51) Int. Cl.
*G03G 15/02* (2006.01)
*G03G 15/06* (2006.01)
*G03G 15/09* (2006.01)

(52) U.S. Cl.
CPC ..... *G03G 15/0266* (2013.01); *G03G 15/0283* (2013.01); *G03G 15/065* (2013.01); *G03G 15/0233* (2013.01); *G03G 15/0907* (2013.01); *G03G 2215/021* (2013.01)

(58) Field of Classification Search
CPC ..... G03G 15/0266; G03G 15/0291; G03G 15/0283; G03G 15/065; G03G 15/1675
USPC ..... 399/50
See application file for complete search history.

(56) References Cited

U.S. PATENT DOCUMENTS 4,785,330 A * 11/1988 Yoshida ..... G03G 15/04018 399/138
7,400,669 B2 * 7/2008 McCorkle ..... H04B 1/71637 375/147
9,904,203 B2 2/2018 Moriguchi
2006/0269327 A1 * 11/2006 Mizumoto ..... G03G 15/0233 399/176
2016/0178540 A1 * 6/2016 Yun ..... G01N 23/205 378/73
2017/0090335 A1 * 3/2017 Moriguchi ..... G03G 15/0266

FOREIGN PATENT DOCUMENTS

JP 10-28328 A 1/1998
JP 2003-316128 A 11/2003
JP 2004-184573 A 7/2004
JP 2017-068081 A 4/2017

* cited by examiner

*Primary Examiner* — Walter L Lindsay, Jr.
(74) *Attorney, Agent, or Firm* — Venable LLP

(57) ABSTRACT

An image forming apparatus includes a movable photosensitive member, a charging roller, an electrostatic image forming portion, a developing sleeve, a charging voltage source, a charging voltage conducting path, a developing voltage source, a developing voltage conducting path, and a capacitor electrically connected between an output terminal of the charging voltage source and a ground potential or between the charging voltage conducting path and the ground potential. The capacitor satisfies the following relationship: $\{C1/(C1+C2)\}\times Vpp\leq 5$ (V), where C1 (pF) is electrostatic capacity formed by the first and second conducting paths, C2 (pF) is electrostatic capacity of the capacitor, and Vpp (V) is a peak-to-peak voltage of the AC component of the developing voltage.

8 Claims, 9 Drawing Sheets

(a)

(b)

IMAGE FORMING APPARATUS

FIELD OF THE INVENTION AND RELATED ART

The present invention relates to an image forming apparatus, such as a copying machine, a printer or a facsimile machine, using an electrophotographic type or an electrostatic recording type.

Conventionally, for example, in order to electrically charge a photosensitive member such as an image bearing member in the image forming apparatus using of the electrophotographic type, as a charging bias, a DC voltage (DC charging type) or an oscillating voltage in the form of the DC voltage biased with an AC voltage (AC charging type) has been applied to a charging member. In the following, a DC component of the charging bias (including the case where the charging bias consists only of the DC component is also referred to as "charging DC bias" and an AC component of the charging bias is also referred to as a "charging AC bias". Further, in such an image forming apparatus, as a developing bias for developing an electrostatic image formed on the photosensitive member, an oscillating voltage in the form of a DC voltage biased with an AC voltage has been applied to a developing member. In the following, a DC component of the developing bias is also referred to as a "charging DC bias" and an AC component of the developing bias is also referred to as a "developing AC voltage".

Further, in such an image forming apparatus, the developing bias interferes with the charging bias, so that an image defect such as an image density fluctuation or image density non-uniformity generates in some cases.

On the other hand, Japanese Laid-Open Patent Application 2003-316128 discloses a method in which a peak of a charging AC bias is adjusted to a rest time of the developing AC bias in a constitution in which a charging bias in the form of a DC voltage biased with an AC voltage and a developing bias in the form of a DC voltage biased with an AC voltage including a rest period are used.

According to this conventional method, an effect of suppressing an interference of the developing AC bias with the peak of the charging AC bias can be expected. However, in a period other than the rest period the interference of the developing AC bias with the charging bias AC bias can still generate.

Particularly, in the case of the DC charging type, an output of the charging DC bias is maintained substantially at a certain value, and therefore, the charging DC bias cannot be outputted in synchronism with the rest period of the developing AC bias. Further, particularly, in the DC charging type, when the charging DC bias fluctuates by the interference of the developing AC bias with the charging DC bias, stripe-shaped image density non-uniformity with respect to a longitudinal direction (direction substantially perpendicular to a surface movement direction) of the photosensitive member is liable to generate.

Here, in order to suppress the interference as described above, it would be considered that a charging high-voltage transmission circuit for connecting a charging member with a charging high-voltage circuit and a developing high-voltage transmission circuit for connecting a developing member with a developing high-voltage circuit are physically spaced from each other. However, this is one of causes of impairing downsizing of the image forming apparatus.

SUMMARY OF THE INVENTION

According to an aspect of the present invention, there is provided an image forming apparatus comprising: a movable photosensitive member; a charging roller provided in contact or proximity to a surface of the photosensitive member and configured to electrically discharge the surface of the photosensitive member under application of a charging voltage consisting only of a DC component; an electrostatic image forming portion configured to form an electrostatic image on the charged surface of the photosensitive member; a developing sleeve provided opposed to the surface of the photosensitive member and configured to deposit toner on the electrostatic image formed on the surface of the photosensitive member under application of a developing voltage including an AC component; a charging voltage source configured to output the charging voltage; a first conducting path configured to electrically connect an output terminal of the charging voltage source to the charging roller; a developing voltage source configured to output the developing voltage; a second conducting path configured to electrically connect an output terminal of the developing voltage source to the developing sleeve; and a capacitor electrically connected between the output terminal of the charging voltage source and a ground potential or between the first conducting path and the ground potential, wherein the capacitor satisfies the following relationship: $\{C1/(C1+C2)\}\times Vpp\leq 5$ (V), where C1 (pF) is electrostatic capacity formed by the first and second conducting paths, C2 (pF) is electrostatic capacity of the capacitor, and Vpp (V) is a peak-to-peak voltage of the AC component of the developing voltage.

Further features of the present invention will become apparent from the following description of exemplary embodiments with reference to the attached drawings.

Figure 7:
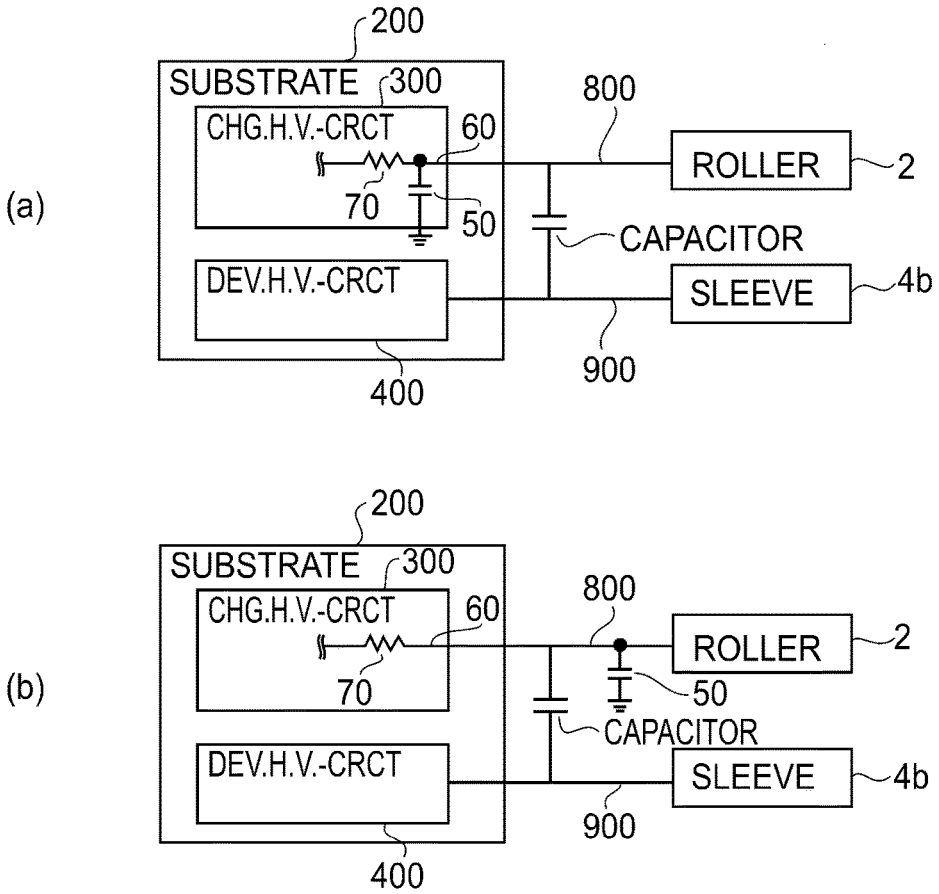

Parts (a) and (b) of FIG. 7 are schematic views each for illustrating a connecting position of a capacitor for suppressing interference.

Figure 8:
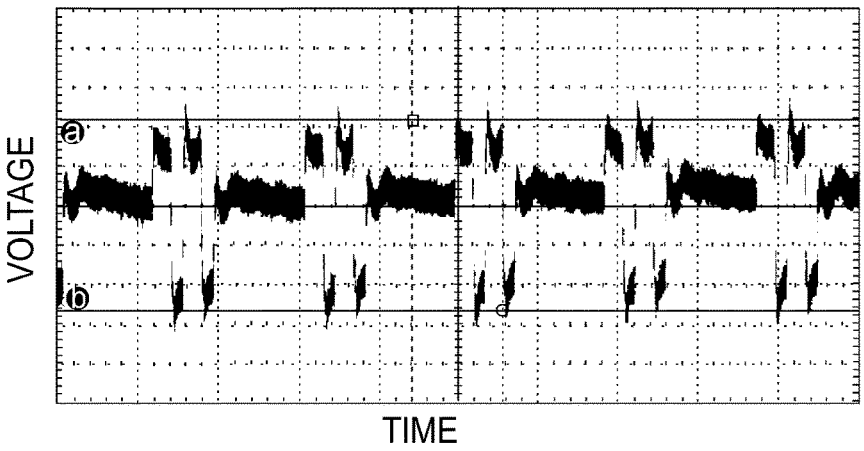

FIG. 8 is a graph showing an example of a measurement result of an interference voltage.

Figure 9:
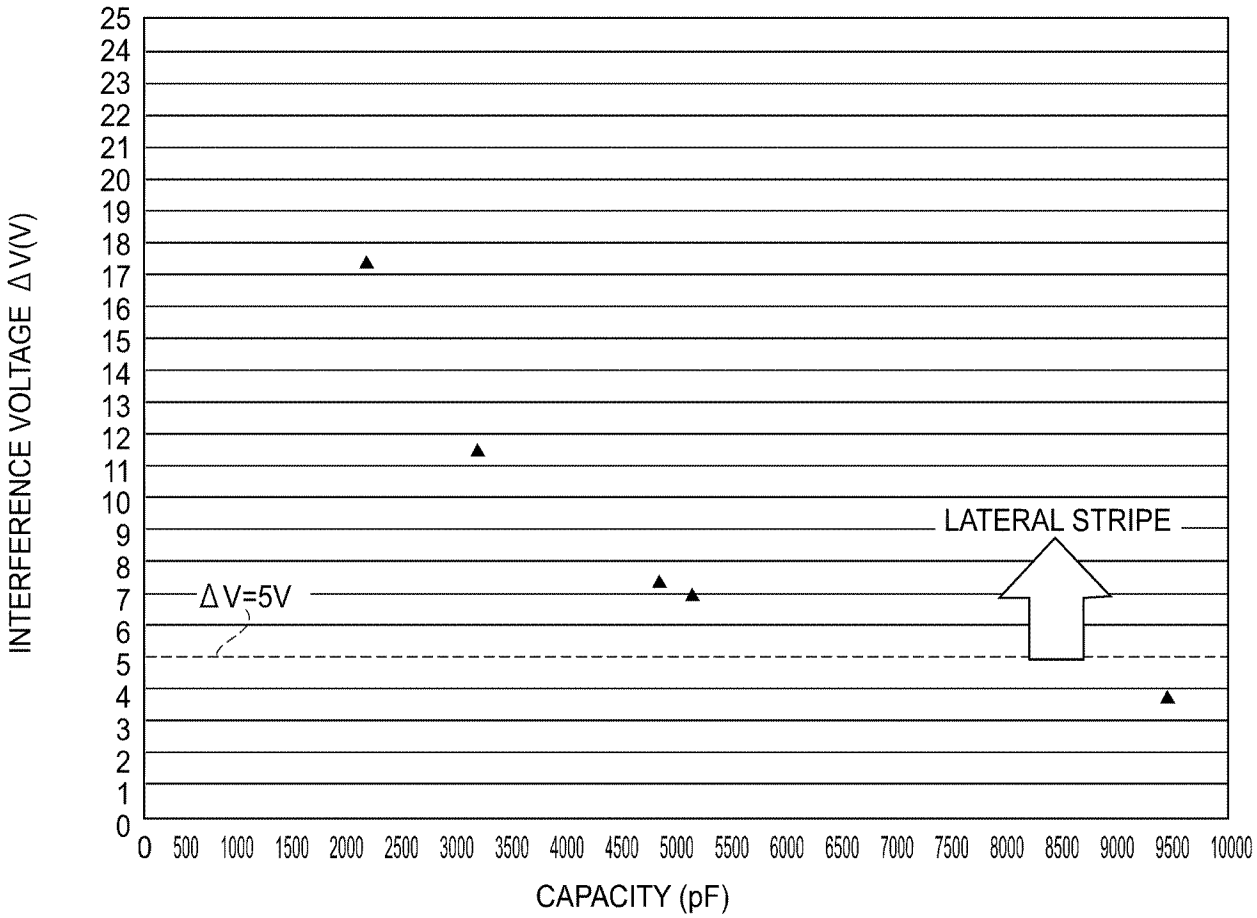

FIG. 9 is a graph showing an example of a relationship between the capacity of the capacitor for suppressing the interference and the interference voltage.

Figure 10:
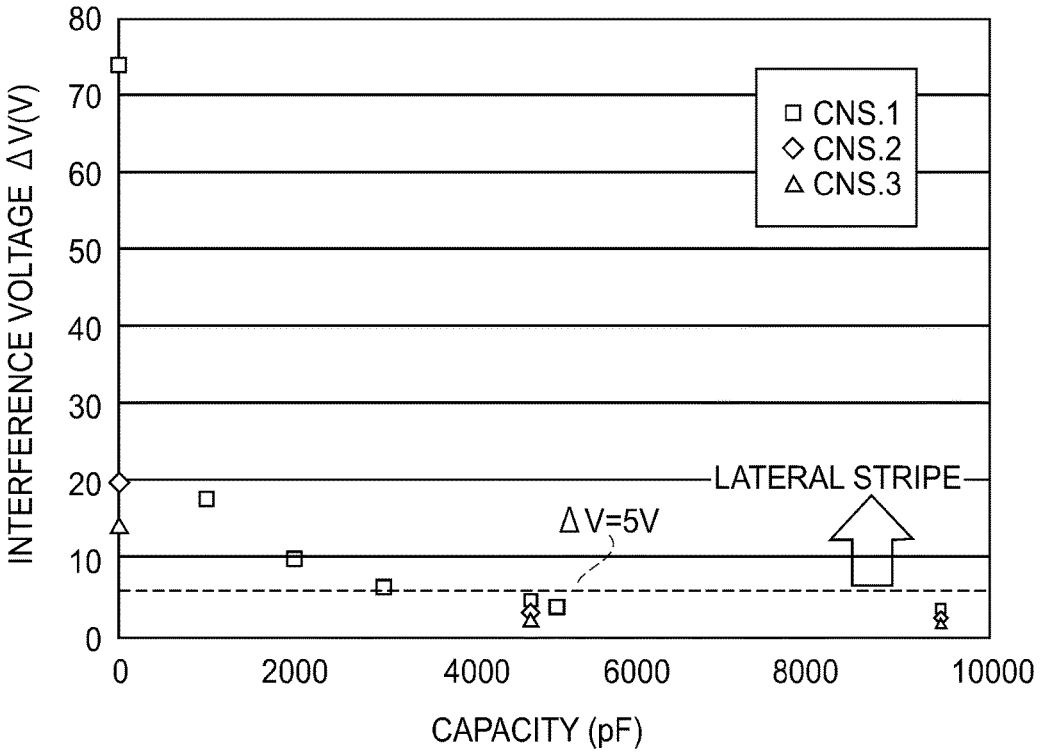

FIG. 10 is a graph showing another example of the relationship between the capacity of the capacitor for suppressing the interference and the interference voltage.

Figure 11:
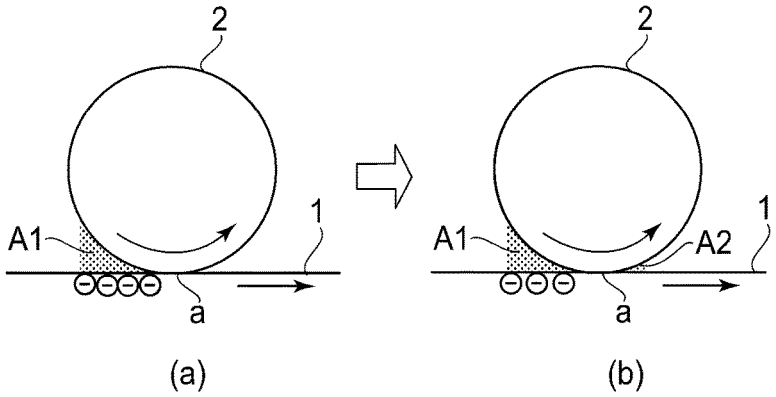

Parts (a) and (b) of FIG. 11 are schematic views for illustrating a mechanism of generation of a charging lateral stripe.

DESCRIPTION OF EMBODIMENTS

In the following, an image forming apparatus according to the present invention will be described further specifically with reference to the drawings.

Embodiment 1

1. General Structure and Operation of Image Forming Apparatus

Figure 1:
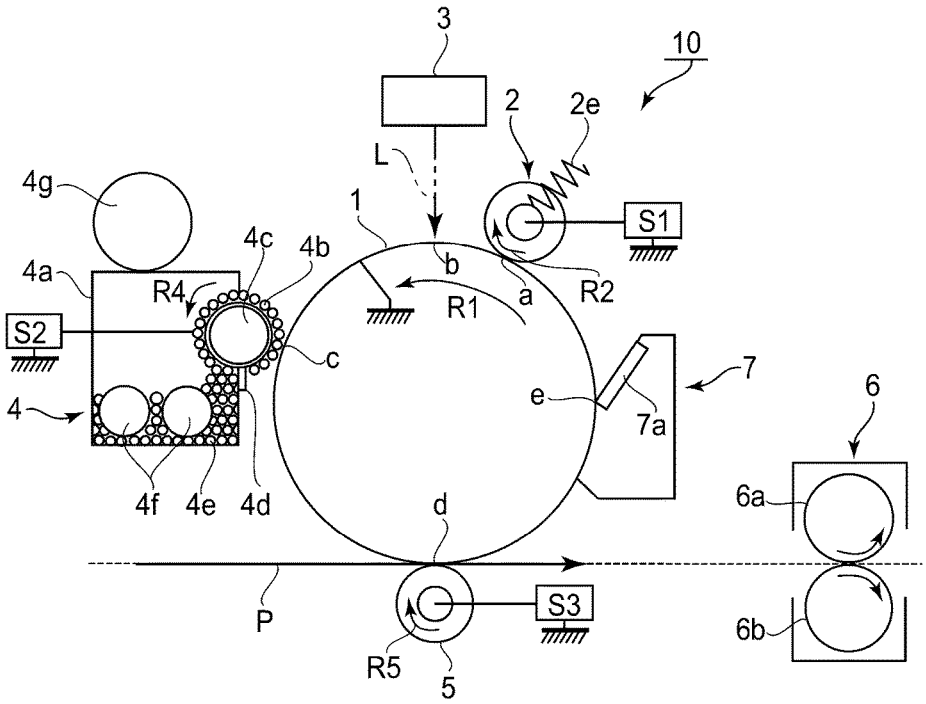
FIG. 1 is a schematic longitudinal sectional view of an image forming apparatus.

FIG. 1 is a schematic longitudinal sectional view of an image forming apparatus 10 according to this embodiment. The image forming apparatus 10 in this embodiment is a laser beam printer in which an image is formed by a contact charging type, a reverse development type, and a transfer type and in which a maximum sheet passing size is an A3 size.

The image forming apparatus 10 includes a photosensitive drum 1 which is a rotatable drum-shaped (cylindrical) electrophotographic photosensitive member as an image bearing member. The photosensitive drum 1 is rotationally driven in an arrow A direction (counterclockwise direction) in the figure. At a periphery of the photosensitive drum 1, along a rotational direction of the photosensitive drum 1, the following means are provided successively. First, a charging roller (roller charger) 2 which is a roller-shaped charging member (contact charging member) as a charging means is disposed. Next, an exposure device 3 as an exposure means (electrostatic image forming means) is disposed. Next, a developing device 4 as a developing means is disposed. Next, a transfer roller 5 which is a roller-shaped transfer member (contact transfer member) as a transfer means is disposed. Next, a cleaning device 7 as a cleaning means is disposed. Further, the image forming apparatus 10 includes a feeding means (not shown) for feeding a transfer(-receiving) material P to a transfer portion d formed between the photosensitive drum 1 and the transfer roller 5, a fixing device 6 as a fixing means provided on a downstream side of the transfer portion d with respect to a feeding direction of the transfer material P, and the like.

Figure 2:
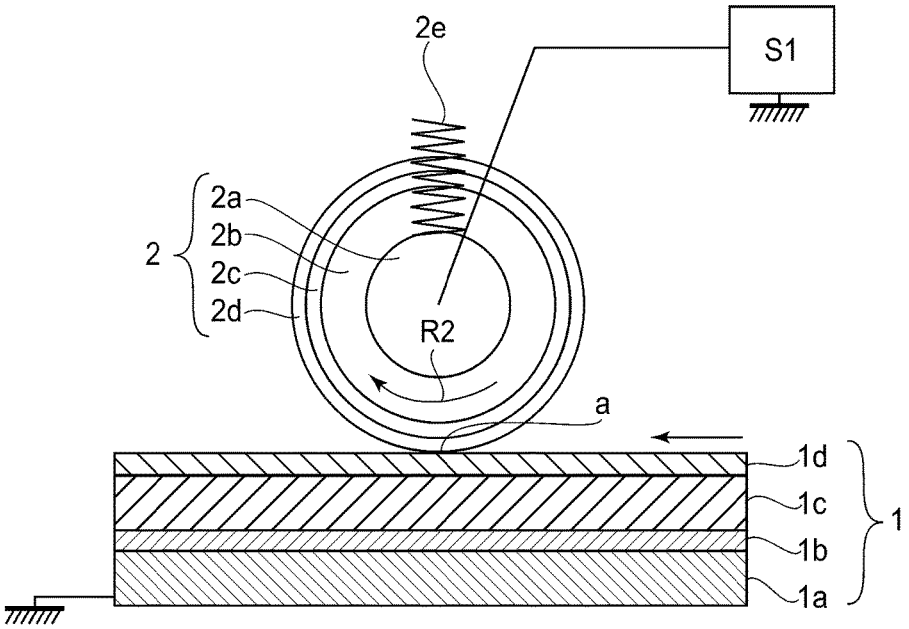
FIG. 2 is a schematic sectional view of a photosensitive drum and a charging roller.

FIG. 2 is a schematic sectional view more specifically showing constitutions of the photosensitive drum 1 and the charging roller 2. The photosensitive drum 1 is a negatively chargeable organic photoconductor (OPC). An outer diameter of the photosensitive drum 1 is 30 mm. The photosensitive drum 1 is rotationally driven at a process speed (peripheral speed) of 200 mm/sec in general in an arrow R1 direction (counterclockwise) in FIG. 1 by a driving motor (main motor) as a driving means (not shown). The photosensitive drum 1 is constituted, as shown in FIG. 2, by applying, onto an outer peripheral surface of an aluminum cylinder (electroconductive drum support) 1*a*, three layers consisting of an undercoat layer 1*b* for suppressing interference with light and for improving an adhesive property with an upper layer, a photo-charge generating layer 1*c* and a charge transporting layer 1*d* in this order.

The charging roller 2 is, as shown in FIG. 2, rotatably held by shaft-supporting (bearing) members (not shown) at both end portions of its core metal (core material) 2*a* with respect to a longitudinal direction (rotational axis direction). The charging roller 2 is urged toward a center direction of the photosensitive drum 1 by an urging spring 2*e* as an urging means at both end portions thereof. As a result, the charging roller 2 is press-contacted to the surface of the photosensitive drum 1 with a predetermined urging force, and is rotationally driven in an arrow R2 direction (clockwise direction) in the figure by rotation of the photosensitive drum 1. A press-contact portion between the photosensitive drum 1 and the charging roller 2 is a charging nip a.

The charging process of the surface of the photosensitive drum 1 as a portion-to-be-charged is made by the electric discharge generating between the charging roller 2 and the photosensitive drum 1. For that reason, the charging of the photosensitive drum 1 is started by applying a voltage of a certain threshold voltage or more to the charging roller 2. In this embodiment, when a negative DC voltage of about 600 V or more as an absolute value is applied to the charging roller 2, an absolute value of a surface potential of the photosensitive drum 1 starts to increase, and thereafter linearly increases with a slope of substantially 1 relative to an applied voltage. For example, in order to obtain the surface potential of −300 V, the DC voltage of −900 V may only be required to be applied, and in order to obtain the surface potential of −500 V, the DC voltage of −1100 V may only be required to be applied to the charging roller 2. This threshold voltage is defined as a discharge start voltage (charge start voltage) Vth. That is, in order to obtain the dark portion potential VD which is the surface potential of the photosensitive drum 1 required for the electrophotographic process, to the charging roller 2, there is a need to apply a direct-current voltage (DC voltage) of not less than the above-described dark portion potential VD, such as VD+Vth.

To the core metal 2*a* of the charging roller 2, from a charging voltage source S1 (corresponding to a charging high-voltage circuit 300 described later) as a charging bias applying means, a charging bias (charging voltage, charging high-voltage) is applied under a predetermined condition. As a result, the peripheral surface the photosensitive drum 1 is electrically charged to a predetermined polarity (negative in this embodiment) and a predetermined potential. In this embodiment, during image formation, in order that the peripheral surface of the photosensitive drum 1 is substantially uniformly charged to the dark portion potential VD=−500 V, as the charging bias, the DC voltage of −1100 V is applied from the charging voltage source S1 to the charging roller 2 (DC charging type).

The charging roller 2 has a length of 320 mm with respect to its longitudinal direction. As shown in FIG. 2, the charging roller 2 has, on an outer peripheral surface of the core metal (supporting member) 2*a*, three layers consisting of a lower layer 2*b*, an intermediary layer 2*c*, and a surface layer 2*d* successively laminated from below. The lower layer 2*b* is a foam sponge layer for decreasing charging noise. The surface layer 2*d* is a protective layer provided for preventing an occurrence of leakage even when a pin hole generates on the photosensitive drum 1. More specifically, the charging roller 2 in this embodiment has the following specification.

Core metal 2*a*: stainless steel rod with a diameter of 6 mm

Lower layer 2*b*: carbon-dispersed foam EPDM (specific gravity: 0.5 g/cm$^3$, volume resistivity: $10^2$-$10^9$ ohm.cm, layer thickness: 3.0 mm)

Intermediary layer 2*c*: carbon-dispersed NBR rubber (volume resistivity: $10^2$-$10^5$ ohm.cm, layer thickness: 700 μm)

Surface layer 2*d*: fluorinated "Torejin" resin in which tin oxide and carbon particles are disposed (volume resistivity: $10^7$-$10^{10}$ ohm.cm, surface roughness (JIS ten-point average surface roughness Ra): 1.5 μm, layer thickness: 10 μm)

The exposure device 3 is a laser beam scanner including a semiconductor laser. The exposure device 3 outputs laser light (beam) L modulated correspondingly to an image signal inputted from an image reading device (not shown). The exposure device 3 subjects the substantially uniformly charged surface of the photosensitive drum 1 to scanning exposure (image exposure) to the light L at an exposure portion b. By this, an absolute value of the potential of the surface of the photosensitive drum 1 at a portion which has been irradiated with the laser light L lowers, so that an electrostatic latent image (electrostatic image) corresponding to the image information is formed on the surface of the photosensitive drum 1. For example, the dark portion potential VD of the photosensitive drum 1 is −500 V, and the light portion potential VL which is the surface potential at an exposed portion of the photosensitive drum 1 is −150 V. In this embodiment, a maximum light quantity of the exposure means 3 is 8 mW.

The developing device 4 is of a two-component magnetic brush developing type. The developing device 4 deposits the toner charged to a charge polarity (negative in this embodiment) of the photosensitive drum 1 on the exposed portion (light portion) of the surface of the photosensitive drum 1 and reversely develops the electrostatic latent image, so that the toner image is formed on the surface of the photosensitive drum 1. The developing device 4 includes a developing container 4*a* in which a two-component developer 4*e* which is a mixture of principally non-magnetic toner particles (toner) and magnetic carrier particles (carrier) is accommodated as the developer. At an opening of the developing container 4*a* provided at an opposing portion to the photosensitive drum 1, a developing sleeve 4*b*, as a developer carrying member, incorporating a fixed magnet roller 4*c* as a magnetic field generating means and being constituted by a non-magnetic material is rotatably provided. The developer 4*e* accommodated in the developing container 4*a* is constrained on the developing sleeve 4*b* by a magnetic force of the magnet roller 4*c* and is coated on the developing sleeve 4*b* in a thin layer. Then, the developer 4*e* is fed by rotation of the developing sleeve 4*b* to a developing portion c where the photosensitive drum 1 and the developing sleeve 4*b* oppose each other. The developer 4*e* in the developing container 4*a* is fed toward the developing sleeve 4*b* while being stirred substantially uniformly by rotation of two developer-stirring members 4*f*.

In this embodiment, the carrier has a volume resistivity of about $10^{13}$ ohm·cm and an average particle size of 40 μm, and the toner is triboelectrically charged to a negative polarity by friction with the carrier. The toner content (concentration) of the developer 4*e* in the toner container 4*a* is detected by a concentration (density) sensor (not shown). On the basis of this detected information, the toner is supplied in an appropriate amount from a toner hopper 4*g* to the developing container 4*a*, so that the toner content of the developer 4*e* in the developing container 4*a* is adjusted to a substantially constant level. At the developing portion c, the closest distance of the developing sleeve 4*b* to the photosensitive drum 1 is kept at 300 and the developing sleeve 4*b* is disposed opposed to the photosensitive drum 1. The developing sleeve 4*b* is rotationally driven in a direction (counterclockwise) indicated by an arrow R4 in FIG. 1 so that surface movement directions of the photosensitive drum 1 and the developing sleeve 4*b* are opposite devices at the developing portion c. To the developing sleeve 4*b*, a developing bias (developing voltage, developing high-voltage) is applied from a developing voltage source S2 (corresponding to a developing high-voltage circuit 400 described later) as a developing bias applying means under a predetermined condition. In this embodiment, as the developing bias, an oscillating voltage in the form of a DC voltage (Vdc) biased with an AC voltage (Vac) is applied from the developing voltage source S2 to the developing sleeve 4*b*. More specifically, in this embodiment, as the developing bias, the oscillating voltage in the form of the DC voltage (−320 V) biased with the AC voltage having a frequency of 8 kHz and a peak-to-peak voltage of 1800 Vpp is applied to the developing sleeve 4*b*.

The transfer roller 5 is contacted to the photosensitive drum 1 with a predetermined urging force, and a transfer portion d is formed at a contact portion between the photosensitive drum 1 and the transfer roller 5. The transfer roller 5 is rotated in an arrow R5 direction (clockwise direction) in the figure by rotation of the photosensitive drum 1. To the transfer roller 5, from a transfer voltage source S3 as a transfer bias applying means, a transfer bias (transfer voltage, transfer high-voltage) is applied under a predetermined condition. In this embodiment, as a transfer bias which is a DC voltage of +500 V of an opposite polarity (positive in this embodiment) to the charge polarity (normal charge polarity) of the toner during development is applied from the transfer voltage source S3 to the transfer roller 5. The toner image on the photosensitive drum 1 is transferred onto the transfer material P such as a recording sheet (paper) at the transfer portion d.

The fixing device 6 includes a rotatable fixing roller 6*a* and a rotatable pressing roller 6*b*. The fixing device 6 fixes the toner image on the transfer material P under heat and pressure application while sandwiching and feeding the transfer material P at a fixing nip between the fixing roller 6*a* and the pressing roller 6*b*. Rotatable speeds of the fixing roller 6*a* and the pressing roller 6*b* are changeable depending on a material, a thickness and a basis weight of the transfer material P.

The cleaning device 7 removes and collects the toner (transfer residual toner), remaining on the surface of the photosensitive drum 1 after the transfer of the toner image onto the transfer material P, from the surface of the photosensitive drum 1. The cleaning device 7 rubs the surface of the rotating photosensitive drum 1 with a cleaning blade 7*a* contacting the photosensitive drum 1. By this, the surface of the photosensitive drum 1 is cleaned by being subjected to removal of the transfer residual toner, and is repetitively subjected to the image formation. A contact portion between the cleaning blade 7*a* and the surface of the photosensitive drum 1 is a cleaning portion e.

Figure 3:
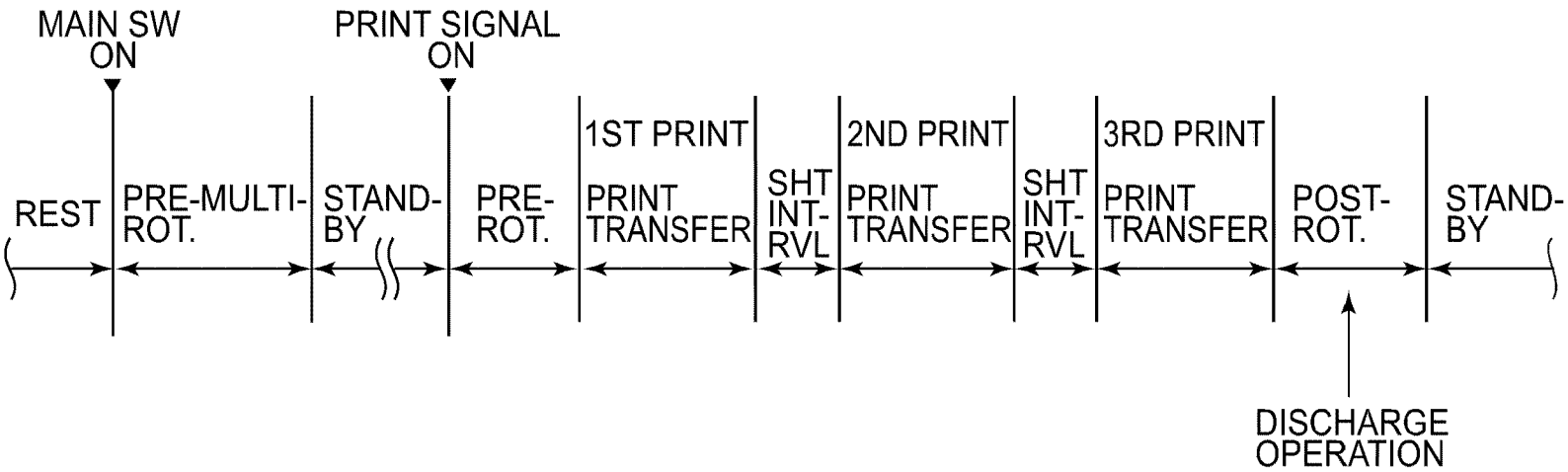
FIG. 3 is a time chart showing an operation sequence of the image forming apparatus.

FIG. 3 is a chart showing an operation sequence of the image forming apparatus 10 in this embodiment.

a. Initial Rotation Operation (Pre-Multi-Rotation Step)

An initial rotation operation (pre-multi-rotation step) is performed in a period in which a starting operation (actuation operation, warming operation) during actuation of the image forming apparatus 10 is performed. The rotational drive of the photosensitive drum 1 is started by turning on a power source switch of the image forming apparatus 10, and a preparatory operation of a predetermined process device, such as rising of the fixing device 6 to a predetermined temperature, is executed.

b. Print-Preparatory Rotation Operation (Pre-Rotation Step)

The print-preparatory rotation operation (pre-rotation step) is performed in a period from turning-on of a print signal (an image formation start signal) until an image forming step (printing step) is actually started, in which the preparatory operation before the image formation is performed. When the print signal is inputted during the initial rotation operation, the operation is executed subsequently to the initial rotation operation. When there is no input of the print signal during the initial rotation operation, the drive of a main motor is once stopped after the end of the initial rotation operation and the rotational drive of the photosensitive drum 1 is stopped, so that the image forming apparatus 10 is maintained in a stand-by state (stand-by) until a (subsequent) print signal is inputted. Then, when the print signal is inputted, the print-preparatory rotation operation is executed.

c. Printing Step (Image Forming Step)

The printing step (image forming step) is performed in a period in which formation, transfer and fixing of the toner image are carried out. When a predetermined print-preparatory rotation operation is ended, subsequently an image forming process on the photosensitive drum 1 is executed, so that the transfer of the toner image formed on the surface of the photosensitive drum 1 onto the transfer material P, the fixing process of the toner image by the fixing device 6, and the like are made and thus an image-formed product is printed out. In the case of an operation in a continuous printing (continuous print) mode, the above-described printing step is repetitively executed correspondingly to a predetermined set print number n.

d. Sheet-Interval Step

A sheet-interval step is performed in a period corresponding to a non-passing state of the transfer material P through a transfer position d, from after passing of a trailing end of a transfer material P through the transfer position d until a leading end of a subsequent transfer material P reaches the transfer position d.

e. Post-Rotation Operation

A post-rotation step is performed in a period in which the photosensitive drum 1 is rotationally driven by continuing the drive of the main motor for some time even after the printing step for a final transfer material P is ended, and thus a predetermined post-operation is executed. In this embodiment, during this post-rotation operation, correspondingly to one full circumference of the photosensitive drum 1, the photosensitive drum 1 is irradiated with the light by the exposure device 3, so that a step of discharging (removing) residual electric charges on the photosensitive drum 1 is performed.

f. Stand-by Step

When the predetermined post-operation is ended, the drive of the main motor is stopped and thus the rotational drive of the photosensitive drum 1 is stopped, so that the image forming apparatus 10 is maintained in a stand-by state until a subsequent print signal is inputted. In the case of printing of a single sheet, after the end of the printing, the image forming apparatus 10 is in the stand-by state through the post-rotation operation. In the stand-by state, when the print signal is inputted, the operation of the image forming apparatus 10 shifts to the print-preparatory rotation operation.

During the printing step c described above is during the image formation, whereas during the initial rotation operation a, during the print-preparatory operation b, during the sheet-interval step d and during the post-rotation operation e, which are described above, are during non-image formation.

In the above, the general structure and operation of the image forming apparatus were described taking, as an example, the case where the image forming apparatus includes a single photosensitive drum. However, the present invention is equivalently applicable to a tandem-type image forming apparatus including a plurality of photosensitive drums. As such an image forming apparatus, a tandem image forming apparatus employing an intermediary transfer type including an intermediary transfer member and a tandem image forming apparatus employing a direct transfer type including a transfer material carrying member are well known. In the tandem image forming apparatus employing the intermediary transfer type, for example, toner images formed on a plurality of photosensitive drums are primary-transferred superposedly onto an intermediary transfer belt formed with an endless surface as an intermediary transfer member and thereafter are secondary-transferred onto the transfer material. This image forming apparatus includes, for example, a plurality of image forming portions each including a photosensitive drum 1, a charging roller 2, an exposure device 3, a developing device 4, a transfer roller (primary transfer roller) 5 and a cleaning device 7 which are similar to those of the image forming apparatus 10 shown in FIG. 1. In the tandem image forming apparatus employing the direct transfer type, for example, toner images formed on a plurality of photosensitive drums are transferred superposedly onto a transfer material carried and fed by a transfer belt formed with an endless belt as a transfer material carrying member. This image forming apparatus includes, for example, a plurality of image forming portions each including a photosensitive drum 1, a charging roller 2, an exposure device 3, a developing device 4, a transfer roller 5 and a cleaning device 7 which are similar to those of the image forming apparatus 10 shown in FIG. 1.

2. Structure of High-Voltage Source

Next, a structure of a high-voltage source for outputting the charging bias and the developing bias in this embodiment will be described. In this embodiment, as described above, the image forming apparatus 10 includes the plurality of image forming portions each provided with a charging high-voltage circuit 300 and a developing high-voltage circuit 400. The plurality of image forming portions form toner images of yellow (Y), magenta (M), cyan (C) and black (K), respectively, and in the case where elements for these colors are distinguished from each other, Y, M, C and K are added to ends of reference numerals (symbols) thereof.

Figure 4:
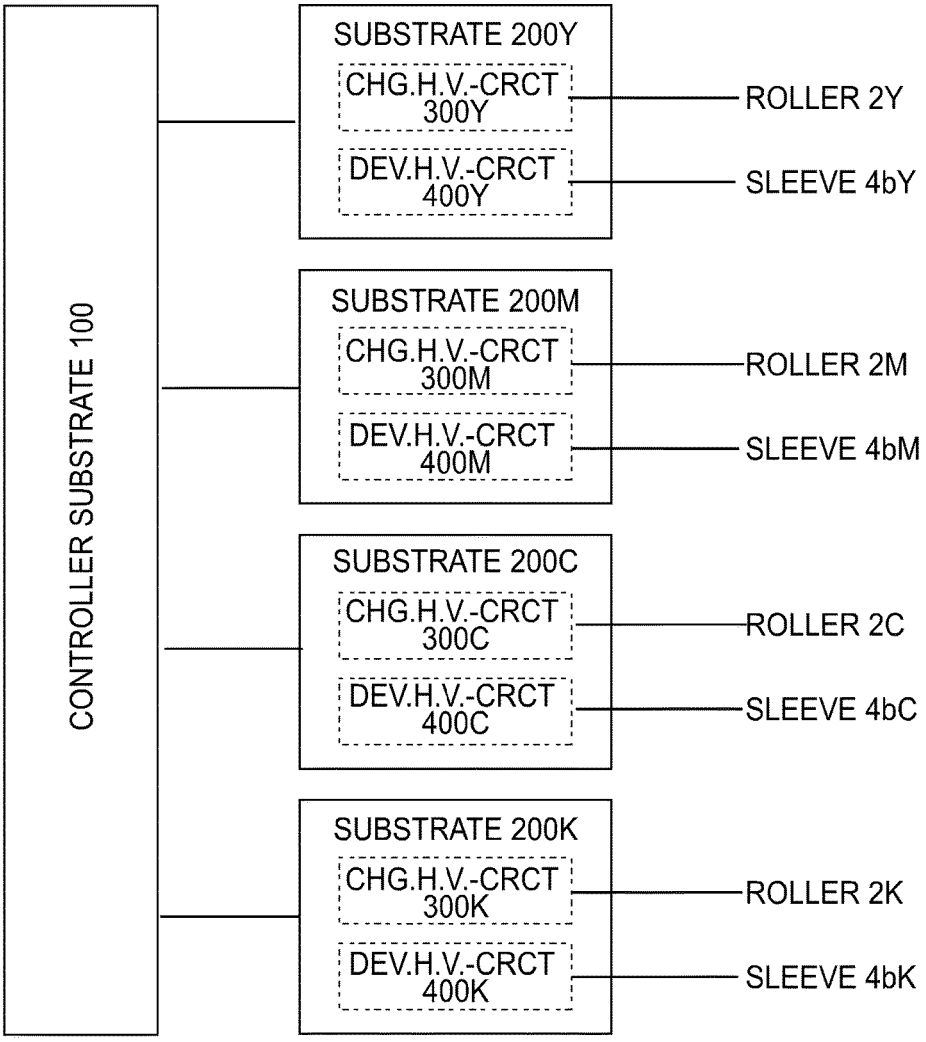
FIG. 4 is a block diagram of a voltage source substrate for generating a charging bias and a developing bias.

FIG. 4 is a block diagram showing the structure of the high-voltage source for outputting the charging bias and the developing bias. The image forming apparatus 10 includes charging and developing substrates 200Y, 200M, 200C and 200K which are high-voltage substrates (composite high-voltage source substrate) and includes a control substrate 100.

The charging and developing substrate 200Y for the yellow is a high-voltage source including a charging high-voltage circuit 300Y for generating output of a voltage (charging high voltage) applied to the charging roller 2Y and a developing high-voltage circuit 400Y for generating output of a voltage (developing high voltage) applied to a developing sleeve 4*b*Y. The charging and developing substrate 200M for the magenta is a high-voltage source including a charging high-voltage circuit 300M for generating output of a voltage (charging high voltage) applied to the charging roller 2M and a developing high-voltage circuit 400M for generating output of a voltage (developing high voltage) applied to a developing sleeve 4*b*M. The charging and developing substrate 200C for the cyan is a high-voltage source including a charging high-voltage circuit 300C for generating output of a voltage (charging high voltage) applied to the charging roller 2C and a developing high-voltage circuit 400C for generating output of a voltage (developing high voltage) applied to a developing sleeve 4*b*C. The charging and developing substrate 200K for the black is a high-voltage source including a charging high-voltage circuit 300K for generating output of a voltage (charging high voltage) applied to the charging roller 2K and a developing high-voltage circuit 400K for generating output of a voltage (developing high voltage) applied to a developing sleeve 4*b*K.

The control substrate 100 carries out a start of an operation and output voltage setting of each of the charging and developing substrates 200Y, 200M, 200C and 200K for an associated image forming portion and carries out acquisition of a detection value in each of the charging and developing substrates 200Y, 200M, 200C and 200K for the associated image forming portion. In this embodiment, the control substrate 100 carries out control of a general operation of the image forming apparatus 10.

Here, the charging and developing substrates 200Y, 200M, 200C and 200K for the respective image forming portions have substantially the same structure. Accordingly, in the following, description will be made by paying attention to one charging and developing substrate as a representative, and suffixes Y, M, C and K of the reference numerals or symbols for representing elements for the respective colors will be omitted.

3. Charging Developing Substrate

Figure 5:
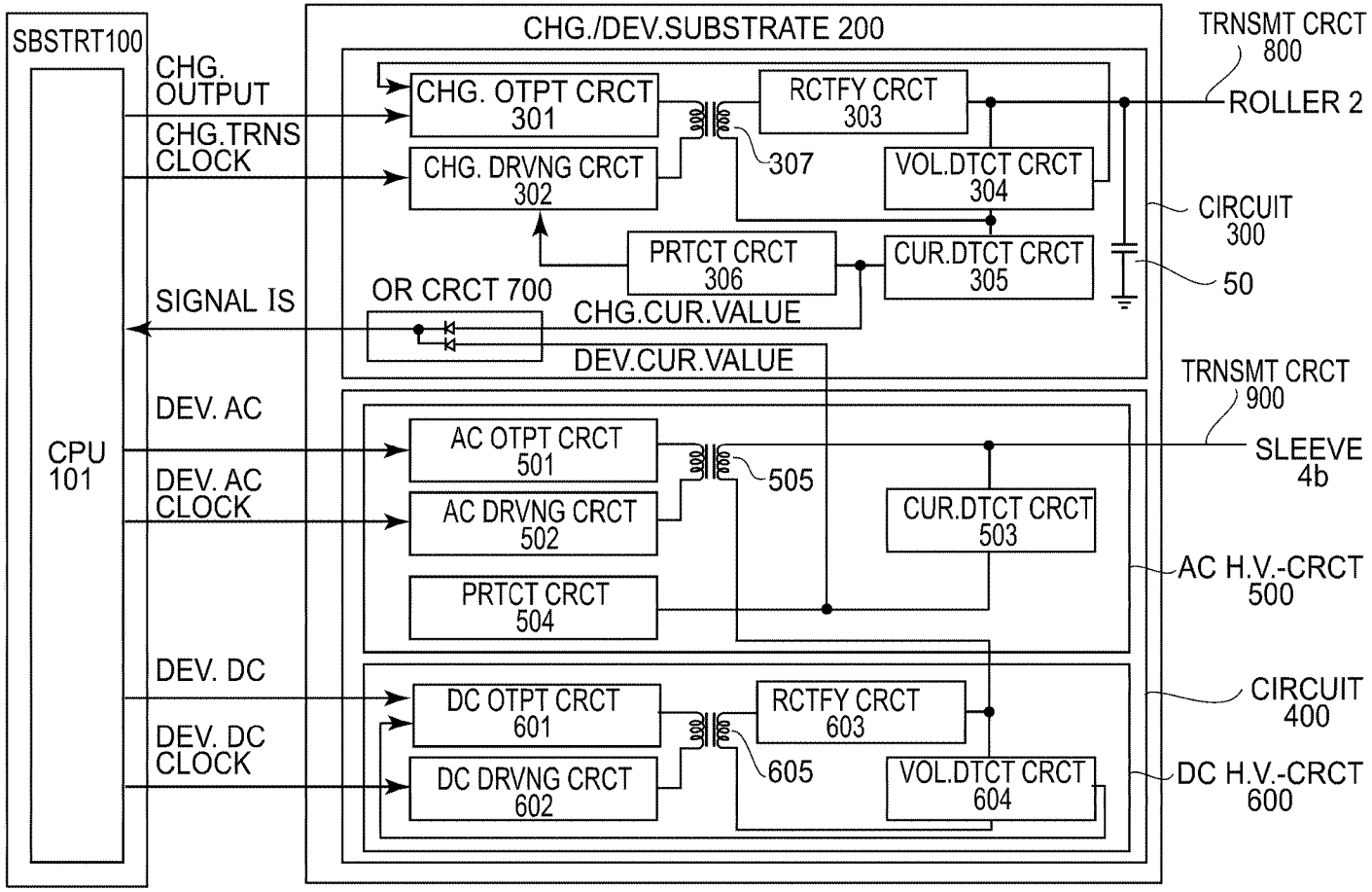
FIG. 5 is a circuit block diagram of a charging and developing substrate in Embodiment 1.

FIG. 5 is a circuit block diagram of the charging and developing substrate 200. The charging and developing substrate 200 includes the charging high-voltage circuit 300 for generating the charging high voltage and the developing high-voltage circuit 400 for generating the developing high voltage. The developing high-voltage circuit 400 includes a developing DC high voltage circuit 600 for generating output of a DC voltage and a developing AC high voltage circuit 500 for generating output of an AC voltage.

The charging high-voltage circuit 300 includes a charging output control circuit 301, a charging transformer driving circuit 302, a charging rectifying and smoothing circuit 303, a charging voltage detecting circuit 304, a charging current detecting circuit 305 and a charging over current protecting circuit 306 and the like. The charging output control circuit 301 is a circuit for outputting a voltage so that a charging output set voltage set by a CPU 101 of the control substrate 100 coincides with a value outputted from the charging voltage detecting circuit 304 described later. The charging transformer driving circuit 302 is a circuit for driving a transformer 307 on the basis of a charging transformer driving clock inputted from the CPU 101 of the control substrate 100. The charging rectifying and smoothing circuit 303 is a circuit for outputting a DC voltage by rectifying and smoothing output of an AC voltage from the transformer 307. The charging voltage detecting circuit 304 is a circuit for converting a charging high voltage into a voltage with a low voltage level and outputting the converted voltage. The charging current detecting circuit 305 is a circuit for converting a current (charging current) flowing from the charging high-voltage circuit 300 to the charging roller 2 into a voltage and outputting the converted voltage. An output (charging current detection value) of the charging current detecting circuit 305 is used for the purposes of input of the output to the charging over current protecting circuit 306 and of detection of charging abnormality of the photosensitive drum 1. The charging over current protecting circuit 306 is a circuit for stopping application of the charging high voltage by stopping the charging transformer driving circuit 302 when the charging current detecting value exceeds a predetermined value and is a circuit for protecting the apparatus so that the output is prevented from excessively increasing during substrate failure.

The charging DC bias outputted from the charging high-voltage circuit 300 is applied to the charging roller 2 via a charging high-voltage transmission circuit (wiring) 800 for connecting the charging high-voltage circuit 300 with the charging roller 2.

The developing DC high voltage circuit 600 includes a developing DC output control circuit 601, a developing DC transformer driving circuit 602, a developing DC rectifying and smoothing circuit 603, a developing DC voltage detecting circuit 604 and the like. The developing DC output control circuit 601 is a circuit for outputting a voltage so that a developing DC output set voltage set by a CPU 101 of the control substrate 100 coincides with a value outputted from the developing DC voltage detecting circuit 604 described later. The developing DC transformer driving circuit 602 is a circuit for driving a transformer 605 on the basis of a developing DC transformer driving clock inputted from the CPU 101 of the control substrate 100. The developing DC rectifying and smoothing circuit 603 is a circuit for outputting a DC voltage by rectifying and smoothing output of an AC voltage from the transformer 605. The developing DC voltage detecting circuit 604 is a circuit for converting a developing high voltage into a voltage with a low voltage level and outputting the converted voltage.

The developing AC high voltage circuit 500 includes a developing AC output control circuit 501, a developing AC transformer driving circuit 502, a developing AC current detecting circuit 503 and a developing AC over current protecting circuit 504 and the like. The developing AC output control circuit 501 is a circuit for outputting a predetermined voltage by setting of a developing AC output set voltage by a CPU 101 of the control substrate 100. The developing AC transformer driving circuit 502 is a full-bridge circuit for driving a transformer 505 on the basis of a developing AC transformer driving clock inputted from the CPU 101 of the control substrate 100. The charging current detecting circuit 503 is a circuit for converting an AC current (developing AC current) flowing to the developing sleeve 4*b* into a voltage and outputting the converted voltage. An output (developing AC current detection value) of the developing AC current detecting circuit 503 is used for the purposes of input of the output to the developing AC over current protecting circuit 504 and of detection of abnormality of high-voltage application to the developing sleeve 4*b*. The developing AC over current protecting circuit 504 is a circuit for stopping application of the developing AC high voltage by stopping the developing AC transformer driving circuit 502 when the charging current detecting value exceeds a predetermined value and is a circuit for protecting the apparatus so that the output is prevented from excessively increasing during substrate failure.

The developing bias in the form of the developing DC bias superposed with the developing AC bias, which biases are outputted from the developing high-voltage circuit 400, is applied to the developing sleeve 4*b* via a developing high-voltage transmission circuit (wiring) 900 for connecting the developing high-voltage circuit 400 with the developing sleeve 4*b*.

Further, in this embodiment, the charging high-voltage circuit 300 is provided with a diode OR circuit 700. The diode OR circuit 700 is constituted by including two diodes. An anode side of each of the diodes is connected with lines of a charging current detection value and a developing AC current charging roller detection value, and cathode sides of the respective diodes are connected with each other ("diode OR"). The diode OR circuit 700 is a circuit for outputting signals of the respective diodes as a single signal (high voltage current detection signal, herein also referred to as "IS"). By using the diode OR circuit 700, IS, which is a higher value of the charging current detection value and the developing AC current detection value, is outputted. That is, IS represents the developing AC current detection value when the developing AC current detection value is higher than the charging current detection value, and represents the charging current detection value when the charging current detection value is higher than the developing AC current detection value. In actuality, a value obtained by subtracting an amount corresponding to a forward direction drop voltage (about 0.6 V) of the diode from each of the detection values is IS. In the case where the charging current detecting circuit 305 and the developing AC current detecting circuit 503 are directly connected with each other and not through the diode OR circuit 700, the current flows from the charging current detecting circuit 305 to the developing AC current detecting circuit 503 or flows in an opposite direction thereof, so that a correct value cannot be detected. For that reason, in this embodiment, by using the diode OR circuit 700, flowing-in of the current between the detection circuits is prevented by the diodes.

4. Charging Lateral Stripe

As described above, particularly in the DC charging type, when the developing AC bias interferes with the charging DC bias and thus the charging DC bias fluctuates, stripe-shaped image density non-uniformity in the longitudinal direction (substantially perpendicular to a surface movement direction) of the photosensitive member (photosensitive drum) is liable to generate. Here, the stripe-shaped image density non-uniformity is referred to as a "charging lateral stripe". Further, a minute gap between the photosensitive member and the charging member is referred to as a "charging gap". Of the charging gap, a portion thereof on a side upstream of the closest portion between the photosensitive member and the charging member (in the case where the photosensitive member and the charging member contact each other, this portion is a contact portion) with respect to the movement direction of the surface (to be electrically charged) of the photosensitive member is referred to as an "upstream gap". Further, of the charging gap, a portion thereof on a side downstream of the closest portion (contact portion) between the photosensitive member and the charging member with respect to the surface movement direction of the photosensitive member is referred to as a "downstream gap".

FIG. 11 is a schematic view for illustrating a mechanism of generation of the charging lateral stripe in the constitution of this embodiment. The photosensitive drum 1 and the charging roller 2 are disposed in contact with each other. The photosensitive drum 1 and the charging roller 2 rotate so that their surface movement directions are the same at the contact portion (charging nip) a. At this time, in an upstream gap A1, a potential difference between the photosensitive drum 1 and the charging roller 2 exceeds a discharge start threshold based on Paschen's law and thus electric discharge generates, so that electric charges are placed on the photosensitive drum 1 and thus a surface potential of the photosensitive drum 1 is a predetermined dark portion potential (VD). When the electric discharge normally generates in the upstream gap A1, as shown in part (a) of FIG. 11, uniform charging of the photosensitive drum 1 is completed, so that an image defect such as the charging lateral stripe does not generate.

However, when the developing AC bias interferes with the charging DC bias, a desired charging DC circuit is not applied to the charging roller 2, so that the uniform charging of the photosensitive drum 1 is not completed in the upstream gap A1 in some instances. In the case where the uniform charging of the photosensitive drum 1 is not completed in the upstream gap A1, as shown in (b) of FIG. 11, incomplete (non-uniformity) minute discharge generates in a downstream gap A2, and at a portion thereof, the surface potential of the photosensitive drum 1 causes non-uniformity thereof, so that the charging lateral stripe generates.

5. Capacitor for Suppressing Interference

In this embodiment, as shown in FIG. 5, in order to suppress the image defect such as the charging lateral stripe as described above, in the charging high-voltage circuit 300, a capacitor 50 for suppressing the interference of the developing AC bias with the charging DC bias is provided.

As regards the interference of the developing AC bias with the charging DC bias, leakage due to capacitive coupling resulting from line capacity generating between the charging high-voltage transmission circuit 800 and the developing high-voltage transmission circuit 900 is one of causes of the interference. In this embodiment, the line capacity generating between the charging high-voltage transmission circuit 800 and the developing high-voltage transmission circuit 900, i.e., line capacity generating between connecting lines (wires) for supplying biases to the charging roller 2 and the developing sleeve 4*b*, is also referred simply to as "line capacity". Particularly, as in this embodiment, in the case where the charging high-voltage circuit 300 and the developing high-voltage circuit 400 are provided on a common substrate (composite high voltage source substrate), a physical distance between the charging high-voltage transmission circuit 800 and the developing high-voltage transmission circuit 900 becomes relatively short (close), and therefore, this interference is liable to generate.

For that reason, the capacitor 50 is required to be connected with a portion where the line capacity generates. In this embodiment, the capacitor 50 is provided between an output terminal of the charging high-voltage circuit 300 and GRD (ground earth, ground) in the high voltage substrate (charging and developing substrate) 200. Specifically, in this embodiment, as schematically shown in part (a) of FIG. 7, an output terminal 60 of the charging high-voltage circuit 300 is provided with a protective resistor 70 for countermeasure against over current. Further, one of terminals of the capacitor 50 is connected in series with a wiring lead of a subsequent stage (charging roller 2 side) to the protective resistor 70 in the charging high-voltage circuit 300, and the other terminal is connected with the GRD in the high voltage substrate (charging and developing substrate) 200. That is, in this embodiment, a connecting position of the capacitor 50 is between the output terminal of the charging high-voltage circuit 300 and the GRD, and is connected in series with the connecting position between the output terminal of the charging high-voltage circuit 300 and the GRD.

A magnitude of an interference voltage of the developing AC bias with the charging DC bias is roughly determined by a peak-to-peak voltage of the developing AC bias and a divided voltage between the line capacity and capacity of the capacitor 50. Here, the line capacity is "C1", the capacity of the capacitor 50 is "C2", and the peak-to-peak voltage of the developing AC bias is "Vpp". At this time, the magnitude of the interference voltage of the developing AC bias with the charging DC bias can be made sufficiently small by making the capacity C2 of the capacitor 50 sufficiently larger than the line capacity C1 under predetermined developing bias setting (Vpp, frequency). As a result, the image defect such as the charging lateral stripe can be sufficiently suppressed.

The capacity C2 of the capacitor 50 can be set depending on the line capacity C1 and the constitution of the image forming apparatus 10 including the developing bias setting, so that the interference voltage of the developing AC bias with the charging DC bias can be sufficiently reduced. In this embodiment, as specifically described later, the capacity C2 of the capacitor 50 is set depending on the line capacity C1 so as to satisfy the following formula:

$$\{C1/(C1+C2)\}\times Vpp(V)\leq 5(V).$$

In the formula, the left side represents an amount of a fluctuation of the potential of the charging high-voltage transmission circuit 800 when the potential of the developing high-voltage transmission circuit 900 fluctuates only by Vpp, i.e., the magnitude of the interference voltage of the developing AC bias with the charging DC bias. That is, depending on the line capacity C1, the capacity C2 of the capacitor C1 may preferably be set so that the interference voltage of the developing AC bias with the charging DC bias is not more than 5 (V) as shown in the right side of the above-described formula. As a result, the image defect such as the charging lateral stripe can be sufficiently suppressed without increasing the capacity C2 of the capacitor 50 more than necessary.

Incidentally, in this embodiment, the line capacity C1 is 20 (pF), and the peak-to-peak voltage Vpp of the developing AC bias is 1750 (V). For that reason, the capacity C2 of the capacitor 50 was set at 9400 (pF). As a result, in the above-described formula, the left side is 3.7 (V), and therefore the above-described formula holds, so that it is possible to sufficiently suppress the image defect such as the charging lateral stripe.

Here, the line capacity C1 between the charging high-voltage transmission circuit 800 and the developing high-voltage transmission circuit 900 is calculated by the following formula through measurement of a fluctuation V of the charging DC bias (voltage value) of a current flowing through the charging high-voltage transmission circuit 800 by using an oscilloscope manufactured by Tektronix Inc.

$$C1=C2\times V/(Vpp-V)$$

Further, the capacity C2 of the capacitor 50 was a value measured using an LCR meter manufactured by HIOKI E.E. Corp.

FIG. 8 shows an example of a result of measurement of the fluctuation amount of the charging DC bias (voltage value) in the case where the capacitor 50 is not provided in the constitution of this embodiment. As shown in FIG. 8, in the case where the capacitor 50 is not provided, a waveform of the charging DC bias shows an amplitude due to the influence of the developing AC bias. An average of peaks when the charging DC bias fluctuates so that an absolute value of the charging DC bias becomes large is a maximum (value), and an average of peaks when the charging DC bias fluctuates so that the absolute value becomes small is a minimum (value). At this time, a difference between the maximum and the minimum is an interference voltage ΔV of the developing AC bias with the charging DC bias. In the case of an example of FIG. 8, the interference voltage ΔV is about 10 (V).

FIG. 9 shows a result of measurement of a change in interference voltage ΔV when the capacity C2 of the capacitor 50 was changed in the constitution of this embodiment. From FIG. 9, it is understood that the interference voltage ΔV gradually decreases with an increasing capacity C2 of the capacitor 50.

Table 1 appearing hereinafter shows a result of a check on a degree of generation of the charging lateral stripe due to the interference voltage ΔV. The charging lateral stripe was evaluated by checking whether or not a stripe-shaped image in a direction perpendicular to the feeding direction (i.e., in a direction substantially parallel to a rotational axis direction of the photosensitive drum 1) is generated on a half-tone image through eye observation. The lateral stripe image was evaluated as "x (poor)" in the case where the lateral stripe image generated to an unacceptable degree, and was evaluated as "o (good)" in the case where the lateral stripe image did not generate.

TABLE 1

| | IV*1 (V) | | | | | |
|---|---|---|---|---|---|---|
| | 34.3 | 17.3 | 11.5 | 7.4 | 6.9 | 3.7 |
| LSI*2 | x | x | x | x | x | o |

*1"IV" is the interference voltage (V).
*2"LSI" is the lateral stripe image.

As shown in Table 1, in the case where the interference voltage ΔV was 3.7 (V) (in this embodiment), the charging lateral stripe (lateral stripe image) did not generate. On the other hand, in the cases of the interference voltages of not less than 6.9 (V), the charging lateral stripe generated. As a result of further study, it turned out that when the interference voltage ΔV was not more than 5 (V), the charging lateral stripe did not generate or was able to be alleviated to the acceptable degree.

As a result of study made similarly as the above-described study, it turned out that a good result was able to be obtained by making the interference voltage ΔV not more than 5 (V) in a range such that the peak-to-peak voltage Vpp of the developing AC bias is 1000 (V) or more and 2500 (V) or less. Further, as a result of study made similarly as the above-described study, even when the interference C1 is large to a degree of about 60 (pF) or less, which is possible in the case where the composite high voltage source substrate is used as in this embodiment, a good result was able to be obtained by making the interference voltage ΔV not more than 5 (V). Incidentally, in the case where the composite high voltage source substrate is used as in this embodiment, typically, the line capacity is 5 (pF) or more. FIG. 10 shows several examples a relationship between the capacity C2 of the capacitor 50 and the interference voltage ΔV and a check result of the degree of generation of the charging lateral stripe in other constitution examples. Incidentally, in a constitution 1 ("CNS. 1") in FIG. 10, the line capacity C1 is 14 (pF), and the peak-to-peak voltage Vpp of the developing AC bias is 1500 (V). Further, in a constitution 2 ("CNS. 2"), the line capacity C1 is 8 (pF), and the peak-to-peak voltage Vpp of the developing AC bias is 1600 (V). Further, in a constitution 3 ("CNS. 3"), the line capacity C1 is 6.5 (pF), and the peak-to-peak voltage Vpp of the developing AC bias is 1750 (V).

As described above, in this embodiment, depending on the line capacity between the charging high-voltage transmission circuit 800 and the developing high-voltage transmission circuit 900, the capacitor 50 for suppressing the interference of the developing AC bias with the charging DC bias is provided in the charging and developing substrate. As a result, the interference between the charging bias and the developing bias which are outputted from the composite high voltage source substrate is sufficiently suppressed, so that the image defect such as the charging lateral stripe can be sufficiently suppressed. Accordingly, according to the present invention, it is possible to suppress the image defect due to the interference between the charging bias and the developing bias while downsizing the image forming apparatus.

Embodiment 2

Next, another embodiment of the present invention will be described. Basic constitution and operation of an image forming apparatus in this embodiment are the same as those in Embodiment 1. Accordingly, elements having the same or corresponding functions or constitutions as those of the image forming apparatus in Embodiment 1 are represented by the same reference numerals or symbols, and will be omitted from detailed description.

Figure 6:
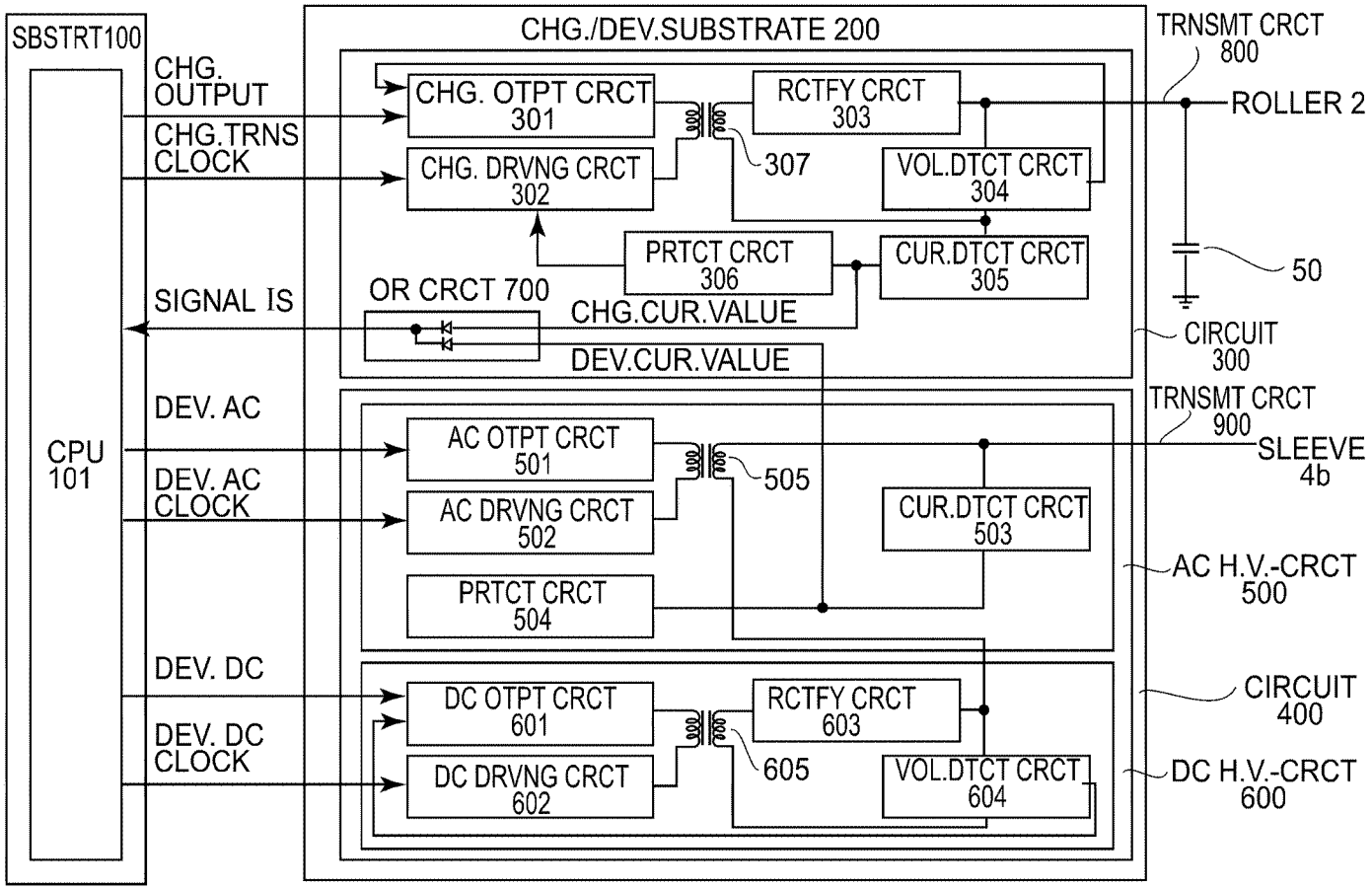
FIG. 6 is a circuit block diagram of a charging and developing substrate in Embodiment 2.

FIG. 6 is a circuit block diagram of a charging and developing substrate 200 in this embodiment. In this embodiment, a capacitor 50 for suppressing the interference of the developing AC bias with the charging DC bias is provided in the charging high-voltage transmission circuit 800.

As described in Embodiment 1, the capacitor 50 is required to be connected with a portion where the line capacity generates. For that reason, in this embodiment, the capacitor 50 is provided between GRD (ground earth, ground) and a connecting line (wiring lead) between the charging high-voltage circuit 300 and the charging roller 2. Specifically, in this embodiment, as schematically shown in part (b) of FIG. 7, one of terminals of the capacitor 50 is connected in series with a wiring lead of the charging high-voltage transmission circuit 800, and the other terminal is connected with the GRD. That is, in this embodiment, a connecting position of the capacitor 50 is between the charging high-voltage transmission circuit 800 and the GRD, and is connected in series with the connecting position between the charging high-voltage transmission circuit 800 and the GRD.

Incidentally, also in the constitution of this embodiment, the capacity C2 of the capacitor 50 is set similarly as in Embodiment 1.

As described above, in this embodiment, depending on the line capacity between the charging high-voltage transmission circuit 800 and the developing high-voltage transmission circuit 900, the capacitor 50 for suppressing the interference of the developing AC bias with the charging DC bias is provided in the charging high-voltage transmission circuit 800. As a result, not only an effect similar to the effect of Embodiment 1 can be obtained, but also a degree of freedom of arrangement of the capacitor 50 can be enhanced compared with Embodiment 1.

Other Embodiments

In the above, the present invention was described in accordance with specific embodiments, but the present invention is not limited to the above-described embodiments.

In the above-described embodiments, the image forming apparatus employed the DC charging type. In the DC charging type, the image defect due to the interference of the developing AC bias with the charging DC bias becomes conspicuous, and therefore, it can be said that the present invention is particularly effective. However, the present invention is not limited thereto. Also in the AC charging type, interference of the developing AC bias with the charging DC bias (DC component) or the like can be suppressed.

In the above-described embodiments, the case where the charging member contacts the surface of the photosensitive drum which is a member to be electrically charged was described as an example, but the charging member is not necessarily required to contact the surface of the photosensitive drum. When an electrically dischargeable region based on Paschen's law is provided between the charging member and the photosensitive drum, the charging member and the photosensitive drum may also be disposed without contact in proximity with each other with a gap (spacing) of about several tens of μm.

Further, the charging member is not limited to the roller-shaped member, but may also be an endless belt stretched by a plurality of stretching rollers or a blade-like member, for example. Further, the image bearing member is not limited to the drum-shaped photosensitive member (photosensitive drum), but may also be an endless belt-shaped photosensitive member (photosensitive belt), for example. Further, when an image forming apparatus of an electrostatic recording type is used, the image bearing member may also be an electrostatic recording dielectric member formed in a drum shape or an endless belt shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-100178 filed on May 19, 2017, which is hereby incorporated by reference herein in its entirety.

What is claimed is:

1. An image forming apparatus comprising:

a movable photosensitive member;

a charging roller provided in contact with or proximity to a surface of said photosensitive member and configured to electrically discharge the surface of said photosensitive member under application of a charging voltage consisting only of a DC component;

an electrostatic image forming portion configured to form an electrostatic image on the charged surface of said photosensitive member;

a developing sleeve provided opposed to the surface of said photosensitive member and configured to deposit toner on the electrostatic image formed on the surface of said photosensitive member under application of a developing voltage including an AC component and a DC component;

a charging voltage source configured to output the charging voltage;

a developing voltage source configured to output the developing voltage;

a first conducting path configured to electrically connect an output terminal of said charging voltage source to said charging roller;

a second conducting path configured to electrically connect an output terminal of said developing voltage source to said developing sleeve; and a capacitor electrically connected between the output terminal of said charging voltage source and a ground potential or between said first conducting path and the ground potential, wherein said capacitor satisfies the following relationship:

$$\{C1/(C1+C2)\}\times Vpp\leq 5(V),$$

where C1 (pF) is an electrostatic capacity formed by said first and second conducting paths, C2 (pF) is an electrostatic capacity of said capacitor, and Vpp (V) is a peak-to-peak voltage of the AC component of the developing voltage.

2. An image forming apparatus according to claim 1, wherein said capacitor is electrically connected between the output terminal of said charging voltage source and the ground potential.

3. An image forming apparatus according to claim 1, wherein said capacitor is electrically connected between said first conducting path and the ground potential.

4. An image forming apparatus according to claim 1, wherein the peak-to-peak voltage Vpp is 1000 V or more and 2500 V or less.

5. An image forming apparatus according to claim 1, wherein the electrostatic capacity C1 is 60 pF or less.

6. An image forming apparatus according to claim 1, wherein said developing voltage source outputs the developing voltage in the form of a DC component biased with an AC component.

7. An image forming apparatus according to claim 1, wherein said charging voltage source and said developing voltage source are provided on a common substrate.

8. An image forming apparatus according to claim 1, wherein the electrostatic capacity C2 is on the order of 1000 pF.

* * * * *